US005859494A

United States Patent [19]

Jeong

[11] Patent Number: 5,859,494

[45] Date of Patent: Jan. 12, 1999

[54] PROCESS FOR MANUFACTURE OF COLOR CATHODE-RAY TUBE

[75] Inventor: Hae-Beob Jeong, Seoul, Rep. of Korea

[73] Assignee: LG Electronics Inc., Seoul, Rep. of Korea

[21] Appl. No.: 682,084

[22] Filed: Jul. 17, 1996

[30] Foreign Application Priority Data

Jul. 28, 1995 [KR] Rep. of Korea ..... 1995-22925

[51] Int. Cl.[6] ..... B05D 5/06; H01J 29/10; H01J 29/00; H01J 40/18

[52] U.S. Cl. ..... 313/364; 427/64; 427/68; 427/71; 427/126.2; 427/157; 427/162; 313/461; 313/467; 313/525

[58] Field of Search ..... 427/64, 71, 68, 427/126.2, 157, 162; 313/364, 461, 467, 525

[56] References Cited

U.S. PATENT DOCUMENTS

| | | | |
|---|---|---|---|
| 3,579,016 | 5/1971 | Palilla | 313/92 |
| 4,081,398 | 3/1978 | Hase et al. | 252/301.4 R |
| 4,122,213 | 10/1978 | Ito et al. | 427/64 |
| 4,123,563 | 10/1978 | Mitobe et al. | 427/68 |
| 4,139,657 | 2/1979 | Watanabe | 427/68 |
| 4,307,320 | 12/1981 | Kotera et al. | 313/474 |
| 5,073,463 | 12/1991 | Fujita | 430/28 |
| 5,178,906 | 1/1993 | Patel et al. | 427/64 |
| 5,340,673 | 8/1994 | Tateyama et al. | 430/23 |
| 5,369,331 | 11/1994 | Mizukami et al. | 313/67 |

*Primary Examiner*—Shrive Beck
*Assistant Examiner*—Michael Barr

[57] ABSTRACT

The present invention relates to a process for manufacture of color cathode-ray tube for preventing the deterioration of color purity of red phosphor while enhancing the brightness and the contrast of color cathode-ray tube, which comprises steps of forming a black matrix film corresponding to 3 colors of green(G), blue(B) and red(R) onto the panel glass by using 0.067–0.075 g atom (content relative to 1 mol of $Y_2O_3$) of europium(Eu) as an activator for red phosphor; forming a 3 color fluorescent film onto said black matrix film, wherein said 3 color fluorescent film consists of green phosphor, red phosphor to which predetermined amount of red pigment having 50–70% of reflectance has been adhered, and blue phosphor to which predetermined amount of blue pigment having 50–65% of reflectance has been adhered; coating an organic film on the 3 color fluorescent film; forming a metal reflective film thereon; and thermally decomposing the organic film at high temperature to obtain a fluorescent plane.

7 Claims, 4 Drawing Sheets

*(CONVENTIONAL ART)*

PROCESS FOR MANUFACTURE OF COLOR CATHODE-RAY TUBE

BACKGROUND OF THE INVENTION

Field of the Invention

The present invention relates to a process for manufacture of color cathode-ray tube, in particular, the process for preventing the deterioration of color purity of a red phosphor while enhancing the brightness and the contrast of color cathode-ray tube.

Description of the Conventional Art

Generally, a fluorescent plane for color cathode-ray tube has been prepared by the following procedures: as illustrated in FIG. 1, a photoresist solution is uniformly coated onto a panel glass(1) and shadow mask is combined thereto and then, light-exposure corresponding to 3 colors of green(G), blue(B) and red(R) is performed; the resulted panel glass is developed with pure water to form a photoresist film; a black matrix layer, which is non-luminous adsorption material, is formed thereto and then,a black matrix film(2) corresponding to 3 colors of green, blue and red is formed by treating the black matrix film (2) with an oxidizer aqueous solution; a fluorescent film is formed by forming 3 color phosphors, which are green phosphor(3G), blue phosphor(3B) adhered by blue pigment(4B), and red phosphor(3R) adhered by red pigment(4R), onto said black matrix film(2) and organic film is formed onto said fluorescent film; and after metal reflective film(5) is smoothly formed thereon, the resulting organic film is heat-decomposed at high temperature, 450° C. to release gases.

In the conventional process for manufacture of color cathode-ray tube as mentioned above, contrast of color cathode-ray tube is improved as blue color near to natural color is reproduced by adhering blue pigment(4B) to blue—phosphor(3B) and red color near to natural color is reproduced by adhering red pigment(4R) to red phosphor(3R). Namely, contrast of color cathode-ray tube has been conventionally improved by reducing reflectance of blue phosphor and red phosphor due to varying adhesion amounts of blue pigment and red pigment, which are respectively adhered to blue phosphor and red phosphor. The reflectance of blue—phosphor wherein blue pigment is adhered to is 20–50%, and the reflectance of red phosphor wherein red pigment is adhered to is 30–50%. Because adhesion amount of pigment is increased to reduce reflectance as described above, pigments are agglomerated in pigment adhesion or pigments are not evenly dispersed into phosphor particles. This results in isolation of pigments from fluorescent film and also brightness of color cathode-ray tube is deteriorated owing to deterioration of luminous brightness of phosphor.

SUMMARY OF THE INVENTION

Thus, an object of the present invention is to provide a process for manufacture of color cathode-ray tube, which enables to prevent the deterioration of color purity of the red phosphor while enhancing the brightness and the contrast of color cathode-ray tube.

In order to achieve the object mentioned above, the present invention provides a process for manufacture of color cathode-ray tube comprising steps of forming a black matrix film(102) corresponding to 3 colors of green(G), blue(B) and red(R) onto above panel glass(101) by using 0.067–0.075 g atom(content relative to 1 mol of $Y_2O_3$) of europium(Eu) as an activator for red phosphor; forming a 3 color fluorescent film onto above black matrix film(102), wherein said 3 color fluorescent film consists of green phosphor (103G), red phosphor (103R) to which predetermined amount of red pigment (104R) having 50–70% of reflectance has been adhered, and blue phosphor(l03B) to which predetermined amount of blue pigment (104B) having 50–65% of reflectance has been adhered; coating an organic film on above 3 color fluorescent film; forming a metal reflective film thereon; and thermally decomposing the organic film at high temperature to obtain a fluorescent plane.

DETAILED DESCRIPTION OF THE INVENTION

Hereinafter, process for manufacture according to the present invention will be described in detail.

Figure 1:
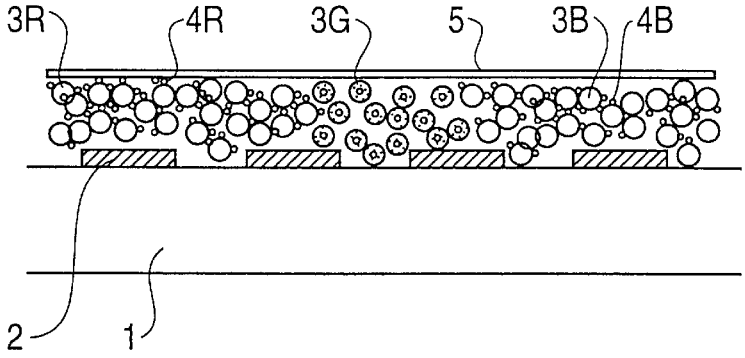
FIG. 1 (CONVENTIONAL ART)
FIG. 1 is a sectional view of the fluorescent plane of a color cathode-ray tube according to a conventional process.
Figure 2:
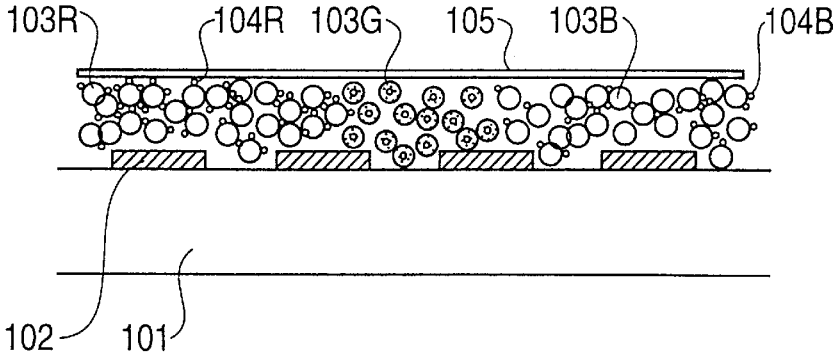
FIG. 2 is a sectional view of the fluorescent plane of a color cathode-ray tube according to the present invention.

At first, black matrix film(102) corresponding to 3colors of green, blue and red, which is light adsorbing layer, is formed on inner surface of panel glass(101) having 36–45% of transmittance. The green phosphor and then the blue and red phosphors are formed on black matrix film(102). Here,in this embodiment, phosphors are used in which predetermined amounts of blue pigment(104B) and red pigment (104R) are applied which increase the reflectance of the blue phosphor by 50–65% and that of the red phosphor by 50–70%, respectively, are coated on the blue phosphor (103B) and red phosphor(103R). The luminous efficiency of blue phosphor and red phosphor is increased by increasing reflectance owing to reduction of adhesion amounts of blue pigment (104B) and red pigment (104R) as mentioned above. After organic film is coated onto above 3 color fluorescent film, metal reflective film (105) is formed thereon and then, organic film is heat-decomposed at high temperature to prepare a fluorescent plane as shown in FIG. 2.

In addition, in case of red phosphor (103R), problem of deterioration of color purity is occurred when adhesion amount of red pigment is decreased, to increase reflectance. The deterioration of color purity is prevented by slightly increasing the content of europium, an activator for red phosphor, to 0.067–0.075 g atom more than that of conventional color cathode-ray tube (content of Eu relative to 1 mol of $Y_2O_3$: 0.04–0.066 g).

Figure 3A:
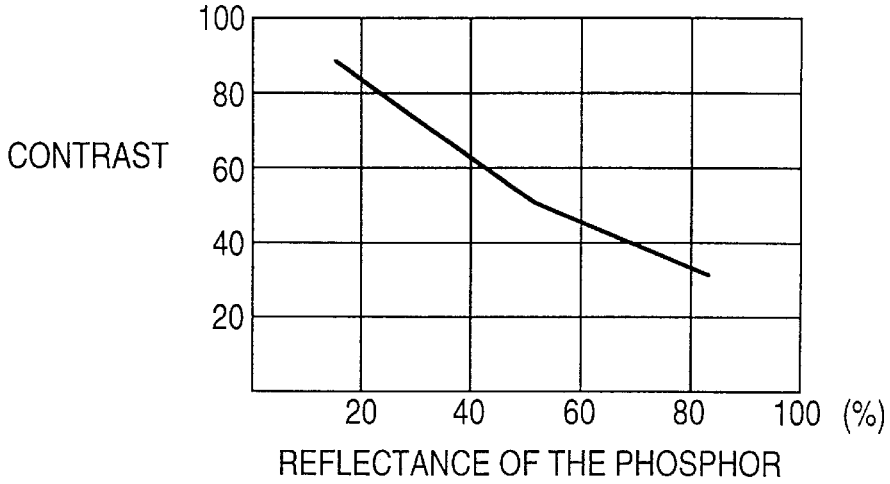
FIGS. 3(*a*) and 3(*b*) are graphs demonstrating the relationships between contrast and the reflectance of the phosphor and between brightness and the reflectance of the phosphor, respectively.
Figure 3B:
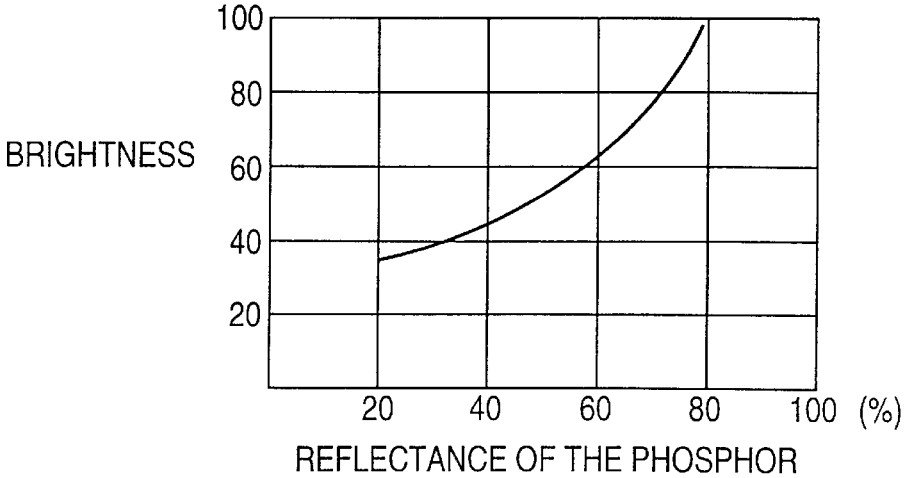

As shown in FIG. 3, when transmittance of panel glass is not more than 36%, contrast is largely enhanced while brightness of color cathode-ray tube is greatly deteriorated, when transmittance of panel glass is more than 45%, brightness is enhanced while contrast is deteriorated. Hence, contrast can be enhanced by using panel glass having lower transmittance (36–45%) than that (42–52%) of conventional panel glass.

Also, amount of blue pigment (104B) adhered to blue phosphor (103B) is decreased to a predetermined amount so as to have 50–65% of transmittance higher than that (20–50%) of blue phosphor of the conventional color cathoderay tube and amount of red pigment (104R) adhered to red phosphor(103R) is decreased to predetermined amount so as to have 50–70% of transmittance higher than that (30–50%) of red phosphor of the conventional color cathode-ray tube.

Figure 4A:
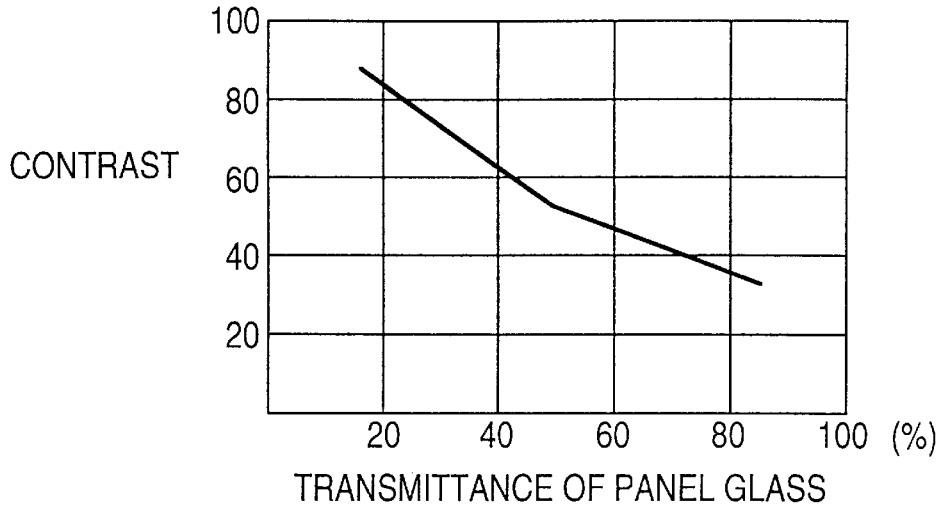
FIGS. 4(*a*) and 4(*b*) are graphs demonstrating the relationship between contrast and the transmittance of panel glass and between brightness and transmittance of panel glass, respectively.
Figure 4B:
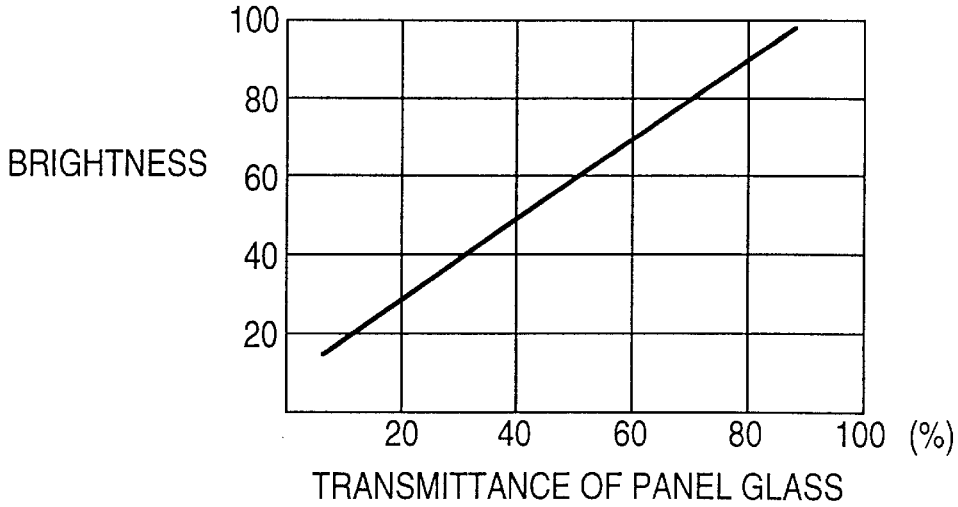

As a result, as shown in FIG. 4(*a*)–4(*b*), when reflectance of blue phosphor and red phosphor respectively are 50–65% and 50–70%, brightness of color cathode-ray tube are good. When reflectance of phosphor is lower than 50%, brightness of color cathode-ray tube is deteriorated due to deterioration of luminous efficiency of phosphor and when reflectance of phosphor is more than 65% or 70%, luminous efficiency of phosphor is increased and it results in increasing of brightness but deteriorating of contrast of color cathode-ray tube and also black effect is reduced due to whitening of outside color of main body of cathode-ray tube.

Figure 5:
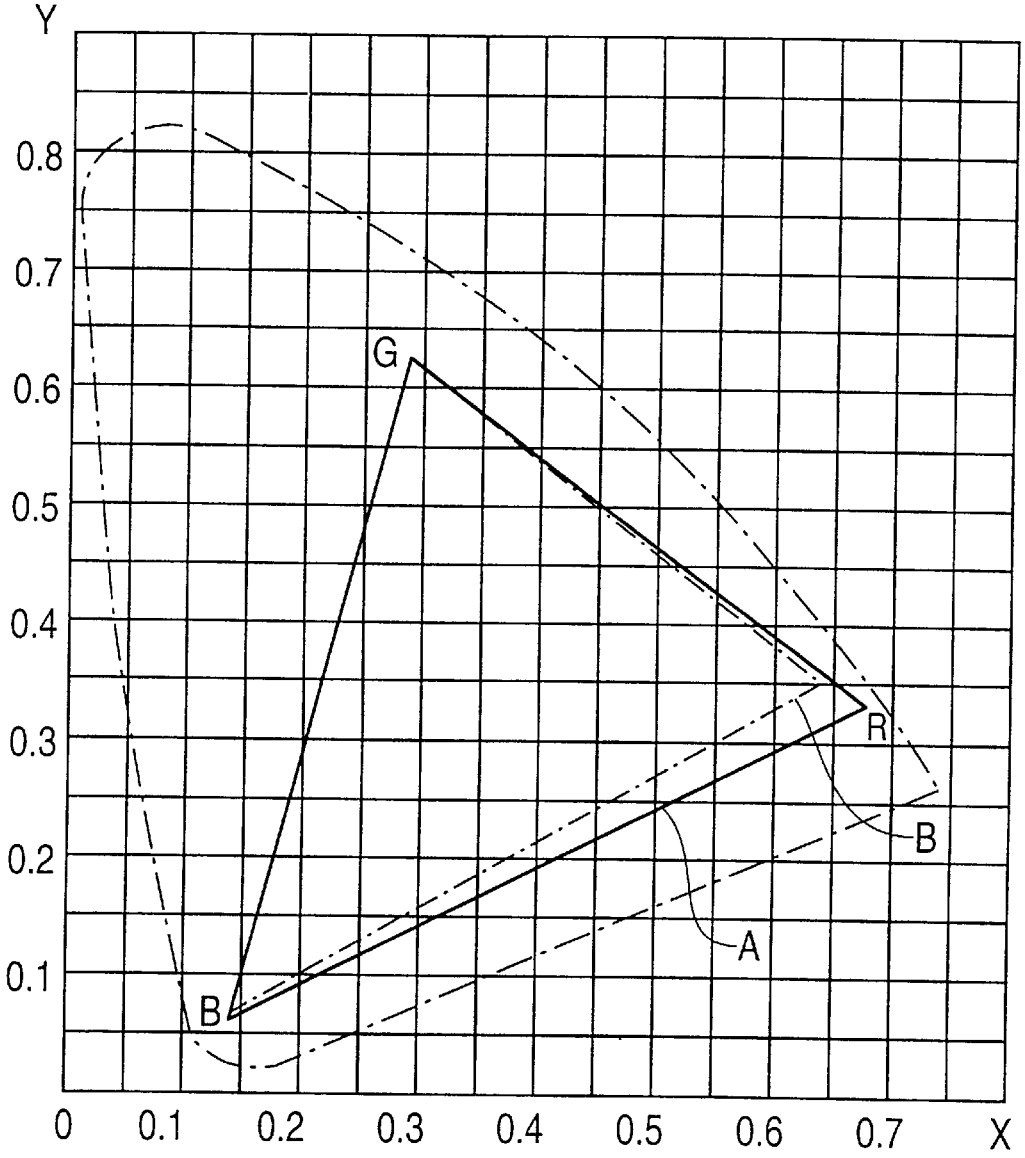
FIG. 5 is a C.I.E. chromaticity diagram of the red fluorescent film of color cathode-ray tube according to the present invention.

However, as described above if reflectance of phosphor is increased by reducing adhesion amount of red pigment (104R) adhered to red phosphor (103R), color purity of red phosphor is deteriorated owing to change of color coordinates on C.I.E. chromaticity diagram. This problem can be solved by slightly increasing the content of activator europium (Eu), which is a factor determining color purity of red phosphor, to 0.067–0.075 g. As shown in FIG. 5, if europium content is slightly increased to 0.067–0.075 g, color reproduction range(A) of red phosphor according to the present invention will be extended more than color reproduction range(B) of conventional red phosphor and as a result, color purity is enhanced in 5–10% compared to typical red phosphor.

As explained here-to-fore, color cathode-ray tube prepared according to manufacture process of the present invention enables to improve the productivity of goods by preventing the isolation and agglomeration of pigments in fluorescent film preparation by reducing adhesion amounts of blue pigment and red pigment adhered to blue phosphor and red phosphor, and also to enhance the brightness of color cathode-ray tube in 10–15% than that of conventional color cathode-ray tube by increasing reflectances of blue phosphor and red phosphor. Also, by using panel glass with low transmittance and slightly increasing amount of europium which is an activator for red phosphor, there is an effect that color purity is improved owing to enlargement of color reproduction range while enhancing contrast of color cathode-ray tube.

What is claimed is:

1. A process for improving color and brightness of a color cathode-ray tube, comprising the steps of:

forming a black matrix film corresponding to three colors of green(G), blue(B) and red(R) onto a panel glass;

forming a three color fluorescent film having green phosphors, red phosphors, and blue phosphors;

adding an activator, which comprises Europium (Eu), along with $Y_2O_3$ to said red phosphors, said activator having a 0.067–0.075 g atom content relative to 1 mol of $Y_2O_3$;

applying a predetermined amount of red pigments and blue pigments to said red and blue phosphors, respectively, wherein said red pigments having a 50–70% reflectance and said blue pigments having a 50–65% reflectance; and forming a fluorescent plane on said three color fluorescent film.

2. The process of claim 1, wherein a transmittance of said panel glass is in a range of 36–45%.

3. The process of claim 1, wherein said step of forming a fluorescent plane further comprises the steps of:

coating an organic film on said three color fluorescent film;

forming a metal reflective film on said coated organic film; and decomposing said organic film.

4. A color cathode-ray tube, comprising:

a panel glass;

a black matrix film formed on said panel glass corresponding to three colors of green(G), blue(B) and red(R);

a three color fluorescent film formed on said black matrix film which comprises green phosphors, red phosphors, and blue phosphors, wherein said red phosphors contain an activator along with $Y_2O_3$, said activator having a 0.067 to 0.075 g atom content per mol of $Y_2O_3$;

red pigments and blue pigments adhered to said red and blue phosphors, respectively, and wherein said red pigment having a 50–70% reflectance and said blue pigments having a 50–65% reflectance; and a reflective film formed on said three color fluorescent film.

5. The color cathode-ray tube of claim 4, wherein a transmittance of said panel glass is in a range of 36–45%.

6. The color cathode-ray tube of claim 4, further comprising a fluorescent plane having an organic film coated on said three color fluorescent film, and the metal reflective film on said organic film.

7. The color cathode-ray tube of claim 4, wherein said activator is europium Eu.

* * * * *